US006854414B1

(12) United States Patent
Huntley

(10) Patent No.: US 6,854,414 B1
(45) Date of Patent: Feb. 15, 2005

(54) PONTOON BOAT DEAD BOLT GATE LATCH ASSEMBLY

(76) Inventor: Jeffery W. Huntley, 178 Inwood Trail, Madison, AL (US) 35758

( * ) Notice: Subject to any disclaimer, the term of this patent is extended or adjusted under 35 U.S.C. 154(b) by 0 days.

(21) Appl. No.: 10/405,818

(22) Filed: Apr. 1, 2003

(51) Int. Cl.[7] ..... B63B 17/00
(52) U.S. Cl. ..... 114/364
(58) Field of Search ..... 114/343, 364; 292/61, 62, 175

(56) References Cited

U.S. PATENT DOCUMENTS

| | | | | | |
|---|---|---|---|---|---|
| 504,262 | A | * | 8/1893 | Adams | 292/62 |
| 3,397,000 | A | * | 8/1968 | Yoshitaka | 292/61 |
| 4,122,631 | A | | 10/1978 | Batcheller | 49/394 |
| 4,742,795 | A | | 5/1988 | DePrey et al. | 114/362 |
| 4,962,954 | A | * | 10/1990 | Ross | 292/175 |
| 5,105,755 | A | | 4/1992 | Davidson | 114/343 |
| 5,125,695 | A | * | 6/1992 | Hartwell | 292/62 |
| 6,443,088 | B1 | | 9/2002 | Putman et al. | 114/343 |

OTHER PUBLICATIONS

Copies of MarineEast catalog pp. 52 and 53 showing Pontoon Boat Gate Latches.
Copy of T–H Marine catalog p. 49 showing Pontoon Boat Gate Holder.

* cited by examiner

*Primary Examiner*—Stephen Avila
(74) *Attorney, Agent, or Firm*—Waddey & Patterson, P.C.; Larry W. Brantley

(57) ABSTRACT

A pontoon boat gate latch assembly includes a bolt assembly and a bolt mounting assembly. The bolt mounting assembly is adapted to be connected to a pontoon boat gate or frame rail so that the bolt assembly can be used to lock the gate in a closed position by inserting a bolt included in the bolt subassembly through a gate rail opening defined in the gate and a frame rail opening defined in the boat frame. The latch assembly also includes gate and frame sleeves that are adapted to be inserted into the gate and frame rail openings to eliminate rattling. The latch assembly further includes an alignment stop that is adapted to be connected to the pontoon boat adjacent to the bolt mounting assembly and to cause the gate to stop at a position that aligns the bolt and the frame and gate rail openings.

11 Claims, 4 Drawing Sheets

PONTOON BOAT DEAD BOLT GATE LATCH ASSEMBLY

BACKGROUND OF THE INVENTION

The present invention relates generally to gate latch assemblies for pontoon boats. More particularly, this invention pertains to a dead bolt gate latch assembly for a pontoon boat.

Gate latches for pontoon boats are known in the art. For example, T-TH Marine, Inc, the assignee of the present application, manufactures a pontoon boat gate latch, shown in FIG. 1, that includes a two-piece base and an arm assembly rotatably connected to the base, both of which are manufactured out of molded Nylon. The base includes a first triangular-shaped base piece, which is connected to one side of a pontoon boat gate made using square tubing, and a second, rectangular-shaped base piece, which is connected to the opposite side of the pontoon boat gate adjacent to the first base piece. Both base pieces are connected to the gate using conventional screws and include openings that are adapted to receive the arm assembly. The arm assembly includes an L-shaped arm piece and a wing nut shaped arm piece connected together using a conventional screw. The L-shaped arm piece includes a small cylinder that is passed through the opening in the triangular base piece and inserted into a large cylinder having a wing nut shaped portion on one end. To secure the gate in place, the arm assembly is rotated into a position where it contacts a pontoon boat rail portion that is adjacent to the gate and the gate latch. Additional information regarding this gate latch may be obtained at T-H Marine's website, www.thmarine.com.

Marine East, located at 802 Mantolocking Road, Brick, N.J. 08723, also manufactures a pontoon boat gate latch. Referring to FIG. 2, the gate latch manufactured by Marine includes a U-shaped base piece and a handle rotatably connected to the base piece. Both the base and handle are manufactured out of high-impact Nylon. This latch is connected to a pontoon boat rail using a conventional screw and the longer leg of the U-shaped base is used to form a stop for a pontoon gate. Once the gate is moved into position against the stop, the handle is rotated down into a position that prevents the gate from moving back out away from the stop and opening up. Another similar version of this latch (not shown), which is identical to the version described above with the exception that it includes a notch in the shorter leg of the U-shaped base member for receiving pontoon boat railing panels, is also manufactured by Marine. Additional information regarding these gate latches may be found at www.marineeast.com.

Another type of pontoon boat gate latch (not shown) includes an externally mounted metal dead bolt assembly and catch. To use this type of gate latch, the dead bolt assembly and catch are mounted to a pontoon boat rail and gate using conventional screws. More specifically, the dead bolt assembly is mounted to the pontoon boat rail and the catch is mounted to the pontoon boat gate so that the catch is adjacent to the dead bolt assembly when the gate is positioned close to the rail. To lock the gate, the dead bolt is slide into the externally mounted catch, which engages the bolt and prevents the gate from moving.

The above-referenced gate latches have several disadvantages. First, all of these latches have limited load-bearing capabilities and can fail when these capabilities are exceeded. With regard to the T-H Marine and Marine East gate latches, these latches place the toad required to hold a gate closed on the rotatable arm or handle, respectively, used with these latches. As a result, the load bearing capability of these latches is dependent on the strength of the arm or handle used with these latches. The metal dead bolt gate latch has a similar deficiency in load bearing capacity. As indicated above, the dead bolt assembly and external catch are both connected to a pontoon boat using conventional screws. In this case, the load bearing capacity of the latch is limited by the strength of the connectors used to mount the dead bolt assembly and the external catch to the pontoon boat.

Second, neither the T-H Marine nor the Marine East latches include mechanisms that prevent these gate latches from inadvertently coming open during normal operation of a pontoon boat, i.e., when the pontoon boat this moving. Finally, the dead bolt type gate latch does not include any mechanism for properly aligning the dead bolt and the catch and can be difficult to properly operate.

Other known pontoon gate latches have additional disadvantages. For example, many known pontoon boat gate latches are expensive. Other gate latches, which include metal on metal contact points, rattle due to vibrations created during normal operations of a pontoon boat. And, others are simply not easy to use.

What is needed, then, is a less expensive, easy to operate, pontoon boat gate latch assembly that has greater load bearing capabilities and does not rattle during normal operations, a mechanism for preventing the inadvertent opening of the latch while a pontoon boat is moving, and a mechanism for ensuring that the latch is properly aligned.

SUMMARY OF THE INVENTION

Accordingly, one object of the present invention is to provide a pontoon boat gate latch assembly that is less expensive than existing pontoon boat gate latches.

Another object is to provide a pontoon boat gate latch assembly that is easy to operate.

A third object of the present invention is to provide a pontoon boat gate latch assembly that has greater load bearing capabilities than existing pontoon boat gate latches.

Still another object is to provide a pontoon boat gate latch assembly that does not rattle during normal boating operations.

Another object of the present invention is to provide a pontoon boat gate latch assembly that will not inadvertently open while a pontoon boat is in motion.

Yet another object is to provide a pontoon boat gate latch assembly that includes a mechanism for ensuring that the latch is properly aligned.

These objects, and other objects that will become apparent to one practicing the present invention, are satisfied by the present invention of a pontoon boat dead bolt gate latch assembly that includes a bolt subassembly and a bolt mounting subassembly. The bolt subassembly includes a bolt that is adapted to be inserted through the frame and gate rails of a pontoon boat and a locking tab, which is connected to the cylindrical bolt and adapted to be locked into locking tab openings defined in the bolt mounting assembly. The bolt mounting subassembly is adapted to receive the bolt subassembly and to be mounted on the pontoon boat so that the bolt subassembly can be inserted through the pontoon boat frame and gate rails. The bolt mounting subassembly includes a locking tab slot running along the length of the bolt mounting subassembly and two locking tab openings defined at each end of the locking tab slot. The locking tab slot is adapted to slideably receive the locking tab and the locking tab openings are adapted to receive and hold the locking tab in place. More specifically, the locking tab openings are adapted to prevent the locking tab from rotating into alignment with the locking tab slot and thereby prevent the gate latch of the present invention from opening while a pontoon boat is moving.

By inserting the bolt subassembly through both the frame rail and the gate rail, the gate latch of the present invention has a load bearing capability that is much larger than that found in existing pontoon boat gate latches. This is true because, rather than having a gate latch that has a load bearing capacity that is dependent upon a rotatable arm or handle, or the connectors used to mount the gate latch on the pontoon boat, the gate latch of the present invention has a load bearing capacity that is dependent on the shear strength of the bolt included with the bolt subassembly and up to four walls of aluminum tubing used to form the frame and gate rails. Also, by using a bolt subassembly that may be operated by simply sliding the bolt into position and pushing the locking tab into one of the locking tab openings, the gate latch of the present invention is very easy to operate.

To reduce the cost of the gate latch of the present invention, the bolt is manufactured using metal and the locking tab is manufactured using plastic. In addition, the bolt mounting subassembly is also manufactured out of plastic. To prevent the gate latch from rattling during normal operations of a pontoon boat, the gate latch assembly of the present invention includes plastic gate and rail sleeves. These sleeves are adapted to be inserted into gate and rail openings, respectively, and to receive the bolt from the bolt subassembly. The sleeves eliminate metal on metal contact points between the bolt and the frame and gate rails and, as a result, eliminate rattling noises. Finally, to ensure that the bolt assembly and the gate and frame rail openings are properly aligned when the pontoon boat gate is closed, the gate catch assembly of the present invention includes an alignment stop, which is adapted to be mounted on the pontoon boat adjacent to the bolt mounting subassembly.

DESCRIPTION OF THE PREFERRED EMBODIMENTS

The gate latch assembly of the present invention is adapted to be used with any one of a variety of conventional pontoon boats known in the art. The structure and components typically found on pontoon boats are well known in the art and will not be discussed in detail here. To facilitate the description of one embodiment of the present invention, however, a generic drawing of a conventional pontoon boat 10 showing several components typically found on a pontoon boat is included in FIG. 3.

Figure 1:
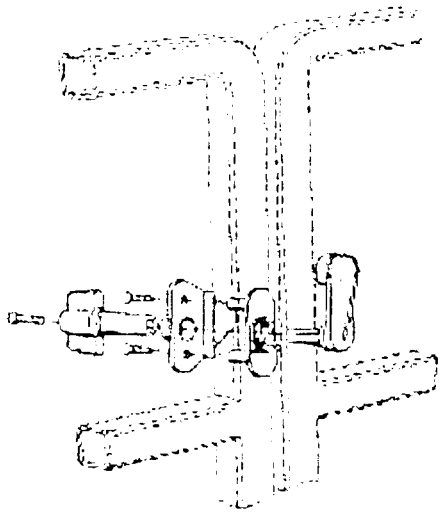
(PRIOR ART) Fig. 1
FIG. 1 is a drawing showing a prior art pontoon boat gate latch having a rotatable arm.
Figure 2:
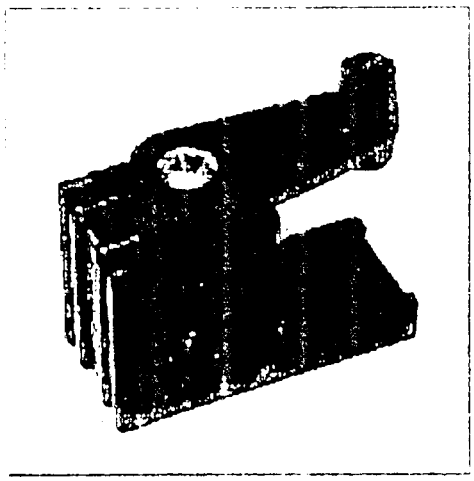
(PRIOR ART) Fig. 2
FIG. 2 is a drawing showing a prior art pontoon boat gate latch having a rotatably handle.
Figure 3:
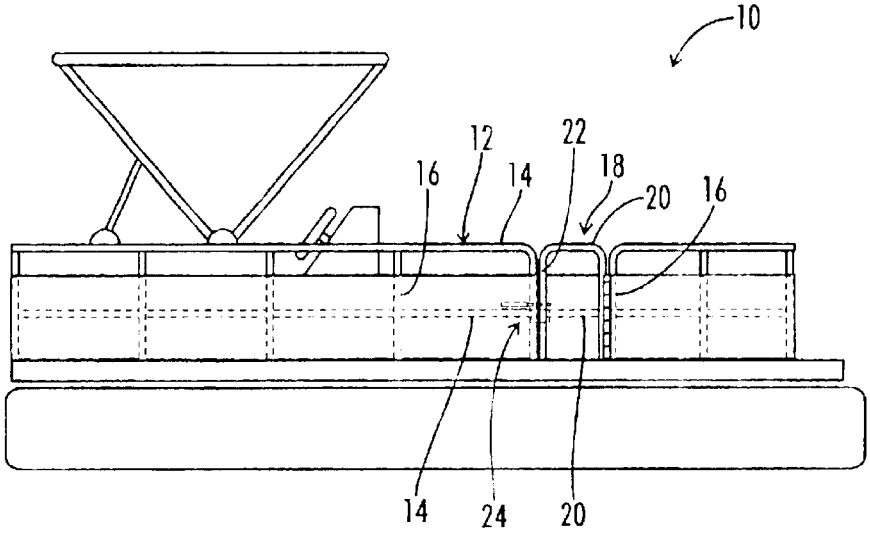
FIG. 3 is a side view of a pontoon boat having hidden lines showing the pontoon boat frame rails and one embodiment of the present invention.

As shown in FIG. 3, the pontoon boat 10 includes a frame 12 having horizontal frame rails 14 (shown using solid and dashed lines) and vertical frame rails 16 (shown, in part, in solid and dashed lines). The boat 10 also includes a gate 18 having horizontal gate rails 20 (the top gate rail shown in solid lines and the lower gate rail shown in dashed lines) and vertical gate rails 22. The frame and gate rails are manufactured using aluminum tubing, which may be cylindrical or rectangular in shape. FIG. 3 also includes dashed lines showing one embodiment of the gate latch 24 of the present invention.

Figure 4:
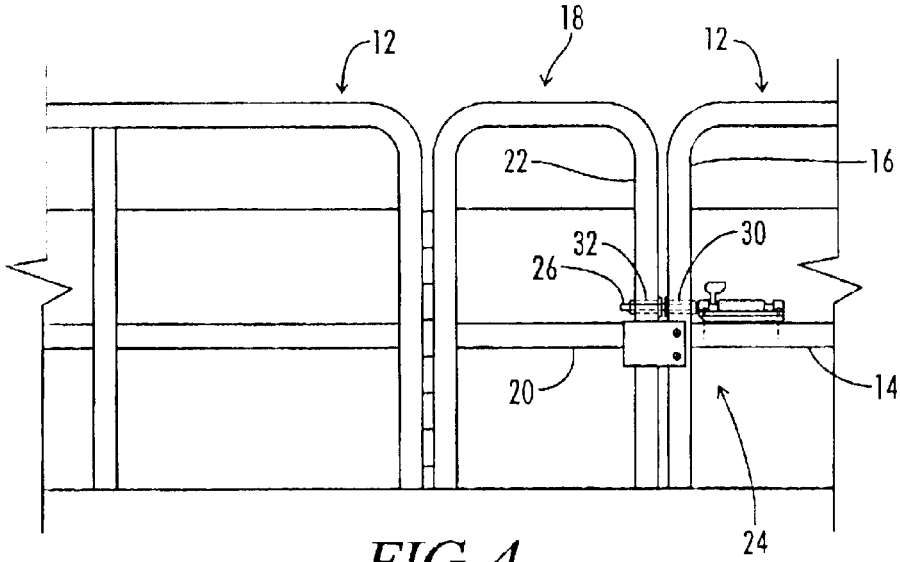
FIG. 4 is an enlarged side view, taken from the inside of the pontoon boat shown in FIG. 3, having hidden lines showing the gale and frame rail sleeves, and the bolt of one embodiment of the present invention, and showing the bolt mounting subassembly and alignment plate of one embodiment of the present invention.

Referring to FIG. 4, which shows an inside view of the pontoon boat gate 18 and frame 12 shown in FIG. 3, the gate latch 24 is adapted to be connected to one of the horizontal frame rails 14 adjacent to the gate 18 or to the horizontal gate rail 20 using conventional screws. As described in detail below, the gate latch 24 should be mounted to the pontoon boat gate rail 20 or the frame rail 14 so that a bolt 26, included as part of a bolt subassembly 28, can be inserted through a frame rail opening 30 (shown as dashed lines) defined in the frame rail 16 and a gate rail opening 32 (shown as dashed lines) defined in the vertical gate rail 22.

Figure 5:
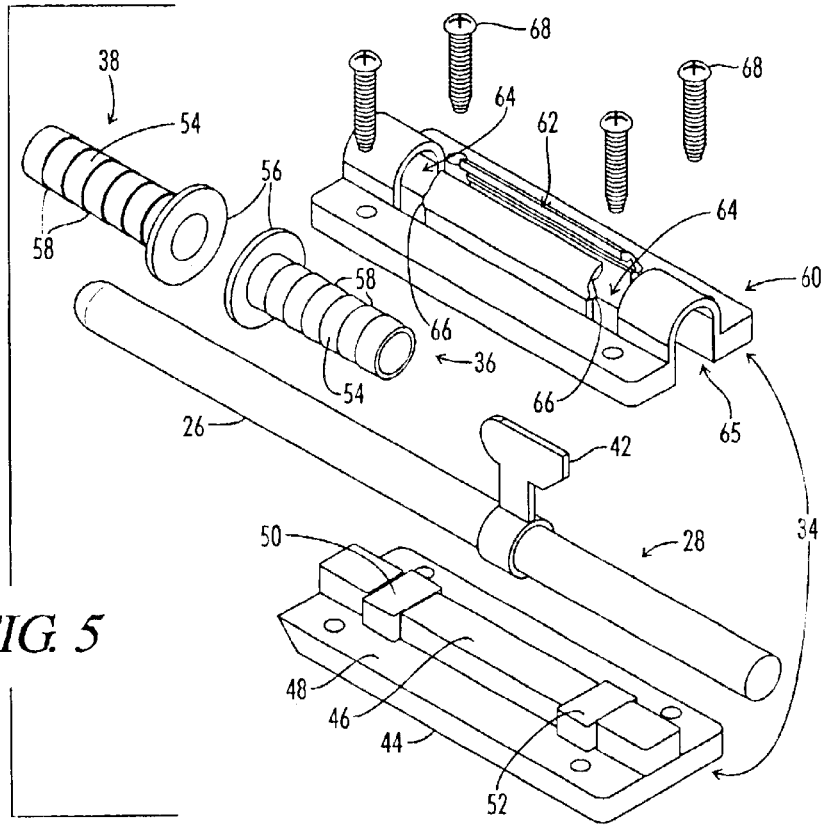
FIGS. 5–8 are side views of one embodiment of the present invention showing the steps necessary to move the bolt subassembly from a locked position to an unlocked position.
Figure 6:
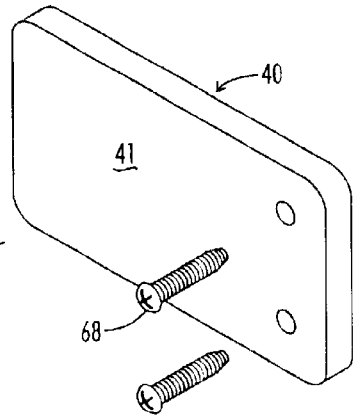

Referring now to FIGS. 5 and 6, one embodiment of the gate latch assembly 24 includes the bolt subassembly 28, a bolt mounting subassembly 34, gate and frame rail sleeves, 36 and 38, and an alignment stop) 40. The bolt subassembly 28 includes the bolt 26 and a locking tab 42, which is connected to the bolt 26. The bolt mounting subassembly 34 includes a lower rectangular portion 44 that includes a rectangular protrusion 46 extending outward from and perpendicular to an upper exterior surface 48 of the lower portion 44. The protrusion 46 has a rectangular shape and runs the length of the lower portion 42. The protrusion 46 also includes two substantially square sections, 50 and 52, located at opposite ends of the protrusion 46.

The bolt mounting subassembly 34 also includes an upper portion 60 having a locking tab slot 62 and two locking tab openings 64 defined in a u-shaped channel 65. The locking tab slot 62 is adapted to slidably receive the locking tab 42. The locking tab openings 64 are adapted to receive and hold the locking tab 42 in place to prevent the gate 18 from inadvertently opening when the pontoon boat 10 is moving. To accomplish this function, each opening 64 includes a resilient flange 66 that extends outward from an edge of each opening 64 and that prevents the locking tab 42 from rotating into alignment with the locking tab slot 62. To lock the locking tab 42 into one of the locking tab openings 64, the locking tab 42 is simply pressed down into the opening 64 and into contact with the resilient flange 66. As the locking tab 42 is pressed into the opening 64, the resilient flange 66 deforms slightly and allows the tab 42 to slide past the resilient flange 66. Once the tab 42 reaches the bottom of the opening 64, the resilient flange 66 returns to its original shape and prevents the tab 42 from moving back past the flange 66 and into alignment with the locking tab slot 62.

With the exception of the bolt 26, which is a one-quarter inch stainless steel barrel bolt, all of the components of the gate latch assembly 24 of the present invention are manufactured using super tough nylon material.

The bolt subassembly 28 is adapted to be connected to the bolt mounting subassembly 34 by inserting the locking tab 42 into the locking tab slot 62 and connecting the upper and lower portions, 60 and 44, to one another using conventional screws 68. The conventional screws 68 are also used to connect the bolt mounting subassembly 34 to the pontoon boat frame rail 14 or the gate rail 20. When the upper and lower portions, 60 and 44 are connected together, the protrusion 46 presses against the bolt 26 and forces it into the u-shaped channel 65. The bolt 26 is captured by the u-shaped channel 65 and the protrusion 46 and can be slid back and forth between the two locking tab openings 64.

The gate sleeve 36 is adapted to be inserted into a gate rail opening 32 defined in the pontoon boat gate 18 and to receive the bolt 26 of the bolt subassembly 28. The gate sleeve 36 includes a cylindrical body 54 having a flange 56 defined on one end, which prevents the gate sleeve 36 from passing through one side of the gate rail opening 32 and out the other side, and a plurality of ribs 58 defined on an exterior surface of the gate sleeve body 54. The ribs 58 prevent the gate sleeve 36 from backing out of the gate rail opening 32 once the sleeve 36 has been inserted into the gate rail opening 32. The gate sleeve 32 is manufactured out of plastic and, as a result, eliminates any metal on metal contact points between the bolt 26 of the bolt subassembly 28 and the gate rail opening 32 of the pontoon boat. The frame rail sleeve 38 is identical to the gate rail sleeve 36 and also includes a cylindrical body 54, a flange 56 defined on one end, and a plurality of ribs 58. The frame rail sleeve is adapted to be inserted into the frame rail opening 30 and to receive the bolt 26.

Referring to FIG. 6, the alignment stop 40 has a rectangular shaped body 41 and is adapted to be connected using conventional screws 68 to the frame rail 16 adjacent to the bolt subassembly 28 and the bolt mounting subassembly 34. Connected as shown in FIG. 4, the alignment stop 40 causes the gate 18 to stop at a position that aligns the bolt 26 with the frame rail opening 30 and the gate rail opening 32. As a result, the bolt 26 can easily be slid through both of these openings.

Referring to FIGS. 7–10, the gate subassembly 28 can be slid along the length of the bolt mounting subassembly 34 and snap locked in two positions. The first position, shown in FIG. 7 and referred to as the closed gate position, locks the bolt subassembly 28 in a position that prevents the gate 18 from being opened. If someone attempts to move the gate 18 when the bolt subassembly 28 is in this position, the bolt 26 prevents that movement. It is also important to note that, in this position, the load bearing capacity of the gate latch assembly 24 is dependent upon the shear strength of the bolt 26, the frame rail 16, and the gate rail 22. This allows the gate latch assembly 24 of the present invention to have a load bearing capacity that is greater than prior art pontoon boat gate latches. In fact, it has been found that the gate latch assembly 24 shown in FIGS. 7–10 meets and exceeds current American Boat and Yacht Council (ABYC) specifications, including ABYC specification numbers H41.6.3.5 and H41.6.3.6. Thus, the gate latch assembly 24 can be used as a safety load-bearing device.

Figure 7:
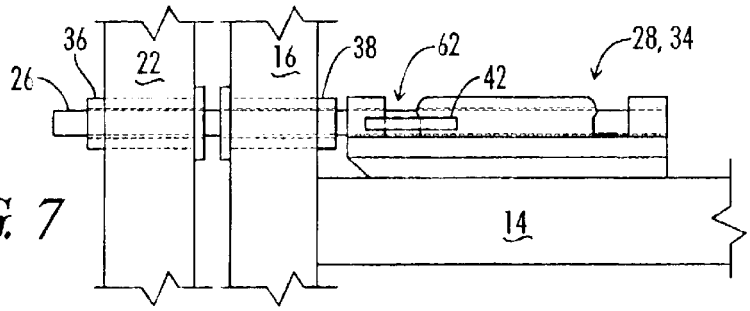
Figure 8:
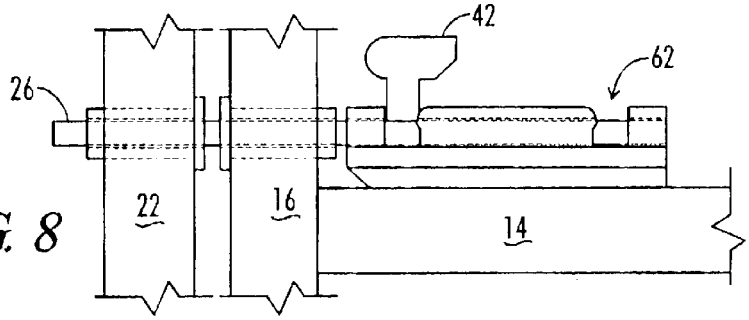
Figure 9:
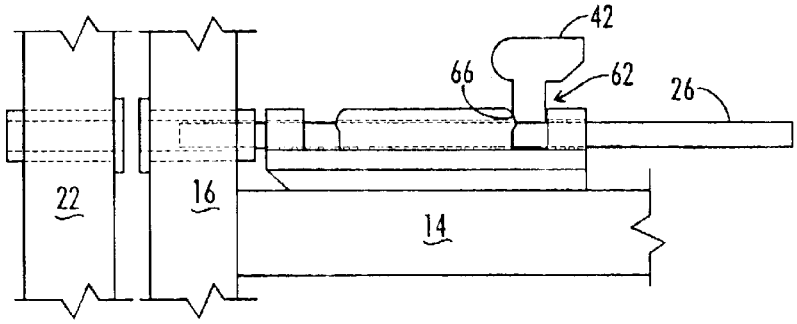
FIG. 9 is an exploded perspective view of one embodiment of the present invention.
Figure 10:
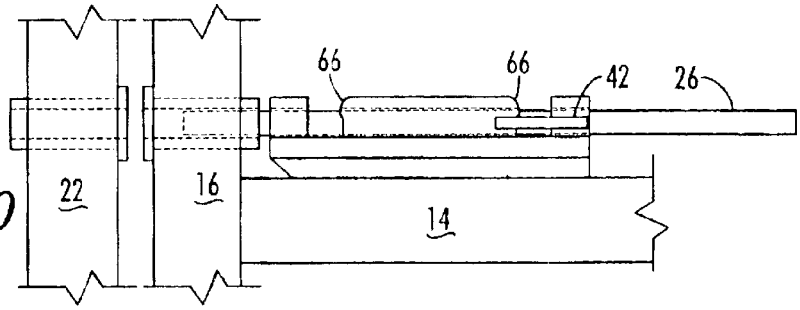
FIG. 10 is a perspective view of one embodiment of the alignment stop of the present invention.

To move the gate subassembly 28 from the closed gate position to a position where the gate 18 can be opened, also referred to as the open gate position, the locking tab 42 is rotated up out of the locking opening 62 until it is in alignment with the locking slot 62. This movement is shown in FIGS. 7–8. From this position, the bolt subassembly 28 is slid along the length of the bolt mounting subassembly 34 until the locking tab 42 is even with the second locking tab opening 62. This movement is shown in FIGS. 8–9. At this point, the locking tab 42 is pressed into the locking tab opening 62 until it deforms and moves past the resilient flange 66 (see FIGS. 9–10).

It is noted that the drawings only illustrate one embodiment of the present invention of a pontoon boat gate latch and a variety of modifications to this embodiment may be made without departing from the scope of the present invention. For example, the bolt mounting subassembly may include a gearing mechanism for sliding the bolt into the frame and gate rail openings. In this alternative embodiment, rather than moving the bolt subassembly by hand, the bolt subassembly might be moved by simply turning a knob connected to the gearing mechanism. In addition, although the various components of the embodiment of the gate latch assembly discussed above are manufactured using metal and plastic, alternative embodiments might be manufactured out of a variety of other materials. The bolt should be manufactured out of materials that provide reasonably high shear strengths and the other components should be manufactured out of lightweight, low cost, materials.

Thus, although there have been described particular embodiments of the present invention of a new and useful Pontoon Boat Dead Bolt Gate Latch, it is not intended that such references be construed as limitations upon the scope of this invention except as set forth in the following claims.

What is claimed is:

1. A pontoon boat gate latch assembly, comprising:

a bolt subassembly;

a bolt mounting subassembly adapted to receive the bolt subassembly and to be mounted on a pontoon boat so that the bolt subassembly can be used to lock a gate on the pontoon boat in a closed position by inserting the bolt subassembly through a gate rail located on the pontoon boat gate and a frame rail located on the pontoon boat, wherein the bolt subassembly includes a gearing mechanism that can be used to insert the bolt subassembly through the pontoon boat gate and frame rails.

2. The gate latch assembly of claim 1, wherein the gearing mechanism includes a knob that can be rotated and the rotation of the knob causes the bolt subassembly to be inserted through the pontoon boat gate and frame rails.

3. A pontoon boat gate latch assembly, comprising:

a bolt subassembly;

a bolt mounting subassembly adapted to receive the bolt subassembly and to be mounted on a pontoon boat so that the bolt subassembly can be used to lock a gate on the pontoon boat in a closed position by inserting the bolt subassembly through a gate rail located on the pontoon boat gate and a frame rail located on the pontoon boat, wherein the bolt mounting subassembly is adapted to be mounted on the pontoon boat so that the bolt subassembly can be used to lock the gate in the closed position by inserting a portion of the bolt subassembly completely through the gate and frame rails.

4. A pontoon boat gate latch assembly, comprising:

a bolt subassembly;

a bolt mounting subassembly adapted to receive the bolt subassembly and to be mounted on a pontoon boat so that the bolt subassembly can be used to lock a gate on the pontoon boat in a closed position by inserting the bolt subassembly through a gate rail located on the pontoon boat gate and a frame rail located on the pontoon boat; and a gate rail sleeve adapted to be inserted into a gate rail opening in the gate rail and to receive the bolt subassembly, wherein the gate sleeve is a hollow cylinder that includes a flanged opening on one end.

5. The gate latch assembly of claim 4, wherein the gate sleeve further includes an exterior surface and a plurality of ribs defined along the exterior surface.

6. The gate latch assembly of claim 5, further comprising:

a frame rail sleeve adapted to be inserted into a frame rail opening in the frame rail and to receive the bolt subassembly.

7. A pontoon boat gate latch assembly, comprising:

a bolt subassembly;

a bolt mounting subassembly adapted to receive the bolt subassembly and to be mounted on a pontoon boat so that the bolt subassembly can be used to lock a gate on the pontoon boat in a closed position by inserting the bolt subassembly through a gate rail located on the pontoon boat gate and a frame rail located on the pontoon boat; and an alignment atop adapted to be connected to the pontoon boat adjacent to the bolt subassembly so that the bolt subassembly is aligned with and can be inserted through a gate rail opening in the pontoon boat gate rail and a frame rail opening in the pontoon boat frame rail.

8. A pontoon boat gate latch assembly comprising:

a bolt subassembly;

a bolt mounting subassembly adapted to receive the bolt subassembly and to be mounted on a pontoon boat so that the bolt subassembly can be used to lock a gate on the pontoon boat in a closed position by inserting the bolt subassembly through a gate rail located on the pontoon boat gate and a frame rail located on the pontoon boat, wherein:

the bolt subassembly includes a bolt manufactured using metal and a locking tab manufactured using plastic; and the bolt mounting subassembly is manufactured using plastic.

9. A pontoon boat gate assembly, comprising:

a bolt subassembly including a bolt and a locking tab connected to the bolt;

a bolt mounting subassembly adapted to slidably receive the bolt subassembly, the bolt mounting subassembly including:

a locking tab slot extending along a length of the bolt mounting subassembly, the locking tab slot adapted to allow the locking tab of the bolt subassembly to be slid along the length of the bolt mounting subassembly; and a locking tab opening located at one end of the slot, the locking tab opening including a resilient flange that extends outward from an edge of the locking tab opening, the locking tab opening adapted to receive and hold the locking tab in place;

a lower portion having a protrusion extending along a length of the lower portion and out away from a surface of the lower portion;

an upper portion connected to the lower portion and having a channel defined therein, the locking tab slot and openings defined in the channel, wherein the locking tab opening is adapted to prevent the locking tab from rotating into alignment with the locking tab slot.

10. A pontoon boat frame and rail assembly for a pontoon boat, comprising:

a pontoon boat frame having a frame rail and a frame rail opening defined in the frame rail;

a pontoon boat gate having a gate rail adjacent to the pontoon boat frame rail and a gate rail opening defined in the gate rail, a bolt subassembly including a bolt and a locking tab connected to the bolt;

a bolt mounting subassembly connected to the pontoon boat frame or gate and adapted to receive the bolt subassembly, the bolt mounting subassembly connected so that the bolt subassembly can be used to lock the gate on the pontoon boat in a closed position by inserting the bolt subassembly through the gate and frame rail openings, a gate rail sleeve in the gate rail opening; and a frame rail sleeve in the frame rail opening.

11. The frame and rail assembly of claim 10, further comprising an alignment stop connected to the pontoon boat frame adjacent to the bolt subassembly so that when the gate is in a closed position the bolt subassembly is aligned with and can be inserted through the frame and gate rail openings.

* * * * *